US006716082B1

(12) United States Patent
Chen Pan

(10) Patent No.: US 6,716,082 B1
(45) Date of Patent: Apr. 6, 2004

(54) PINWHEEL

(76) Inventor: Hai-Lung Chen Pan, No. 221, Sec. 2, Chang-An E. Rd., Taipei (TW)

( * ) Notice: Subject to any disclaimer, the term of this patent is extended or adjusted under 35 U.S.C. 154(b) by 0 days.

(21) Appl. No.: 10/317,459

(22) Filed: Dec. 12, 2002

(51) Int. Cl.[7] ..... A63H 33/40
(52) U.S. Cl. ..... 446/217; 446/236
(58) Field of Search ..... 446/217, 218, 446/236, 243, 266; 40/440, 479, 412, 422; 73/170.05

(56) References Cited

U.S. PATENT DOCUMENTS 1,443,585 A * 1/1923 Mitchel et al.
1,542,324 A * 6/1925 Samour
2,972,481 A * 2/1961 Shapiro
3,747,263 A * 7/1973 Grossberg ..... 46/58
5,092,809 A * 3/1992 Kessler ..... 446/217

* cited by examiner

*Primary Examiner*—Jamila Williams
*Assistant Examiner*—Derris H. Banks
(74) *Attorney, Agent, or Firm*—Alan Kamrath

(57) ABSTRACT

A pinwheel has a rod, a shaft and multiple blade elements. The blade elements are rotatably attached to the shaft, and each blade element has a cutout so as to define a passage for wind passing therethrough in the blade element. In such a pinwheel, the blade elements can be actuated to rotate in any direction of wind passing through the pinwheel. In addition, multiple layers of blade elements can be mounted in the shaft to make the appearance of the pinwheel versatile.

4 Claims, 5 Drawing Sheets

PINWHEEL

BACKGROUND OF THE INVENTION

1. Field of the Invention

The present invention relates to a pinwheel, and more particularly to a pinwheel with a versatile appearance.

2. Description of Related Art

With reference to FIG. 5, a conventional pinwheel in accordance with the prior art substantially comprises a rod (30), a shaft (32) and multiple blades (34). The shaft (32) is perpendicularly attached to the rod (30) near the top of the rod (30). The blades (34) are rotatably attached to the shaft (32). In practice, each blade (34) of the conventional pinwheel is a flat element with a large area and is bent to connect to two ends of the shaft with two ends of each blade (34) so as to form a contact area on the blade (34). When wind passes through the pinwheel and hits the contact areas on the blades (34), the blades (34) will be actuated to rotate by the wind. Additionally, the blades (34) will be actuated to rotate by means of blowing by the user, and an enjoyment will be provided to the user.

However, to actuate the blades to rotate, the contact areas of the blades (34), i.e. the front side of the pinwheel, must face against the wind or face the blowing from the user. When the wind passes through the pinwheel from the rear side of the pinwheel, or the user blows from the rear side of the pinwheel, the blades will not be actuated to rotate. To play with the conventional pinwheel is limited and is not enjoyable. In addition, the conventional pinwheel usually has only one layer of blades (34), such that the appearance of the conventional pinwheel is not versatile. When there are multiple layers of blades (34) mounted on the shaft 32, the layers of blades (34) must be arranged on the shaft (32) in a line. Accordingly, the length of the shaft (32) must be prolonged, and the volume of the pinwheel is enlarged. The conventional pinwheel with multiple layers of blades (34) is not particularly attractive to the market.

To overcome the shortcomings, the present invention tends to provide a pinwheel to mitigate or obviate the aforementioned problems.

SUMMARY OF THE INVENTION

The main objective of the invention is to provide a pinwheel with a versatile appearance. The pinwheel has a rod, a shaft and multiple blade elements. The blade elements are securely attached to a sleeve rotatably mounted around the shaft, and each blade element has a cutout so as to define a passage in the blade element for the wind passing through. Accordingly, the blade elements can be actuated to rotate in any direction of wind passing through the pinwheel. In addition, another layer of blade elements can be mounted in the blade elements so as to make the appearance of the pinwheel versatile.

Other objectives, advantages and novel features of the invention will become more apparent from the following detailed description when taken in conjunction with the accompanying drawings.

DETAILED DESCRIPTION OF PREFERRED EMBODIMENT

Figure 1:
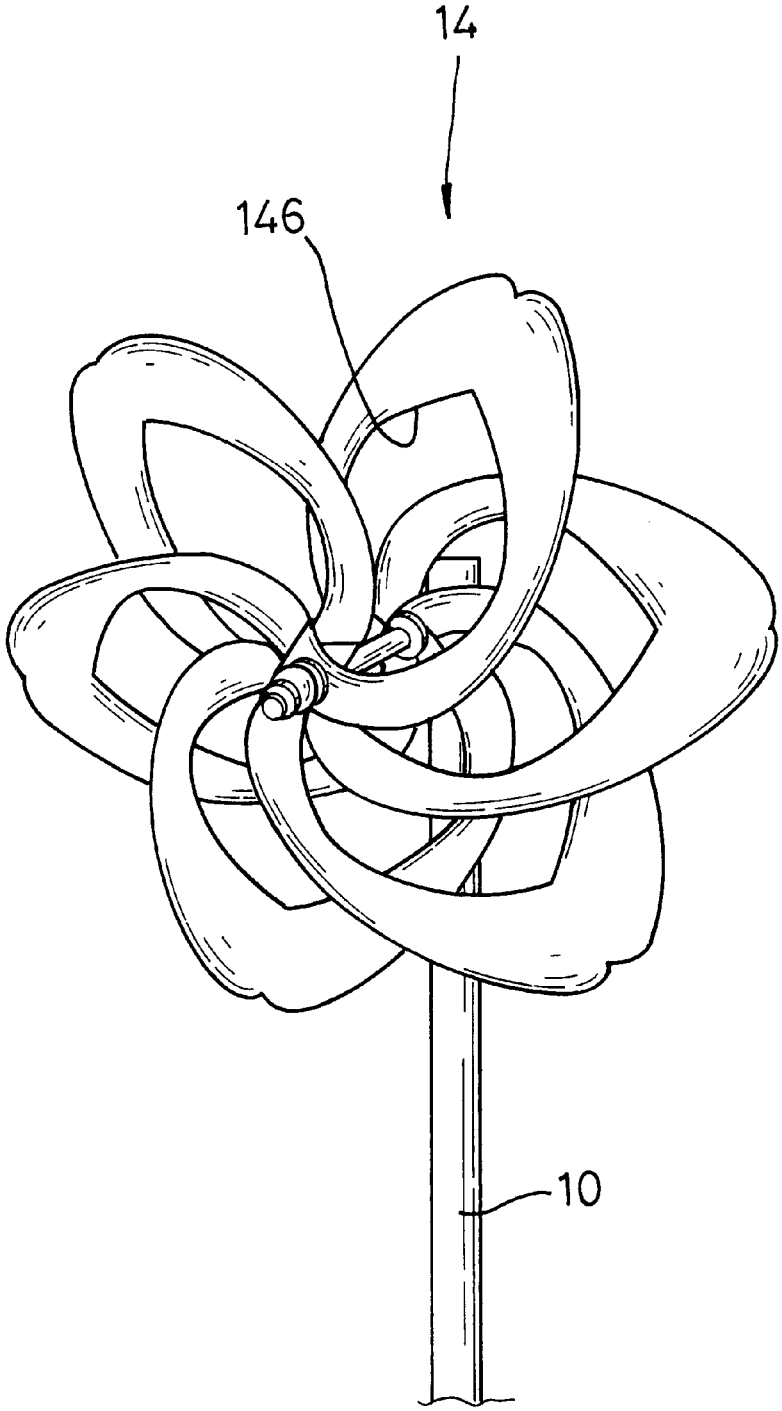
FIG. 1 is a perspective view of a pinwheel in accordance with the present invention.
Figure 2:
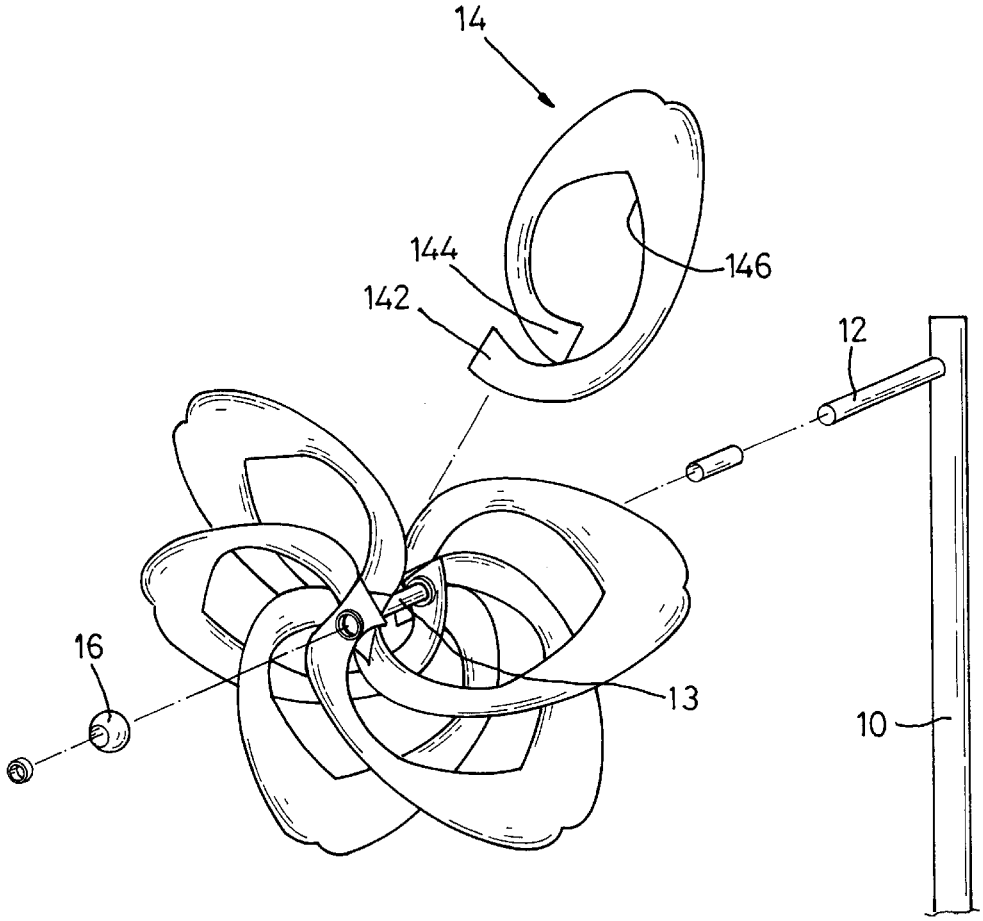
FIG. 2 is an exploded perspective view of the pinwheel in FIG. 1.
Figure 3:
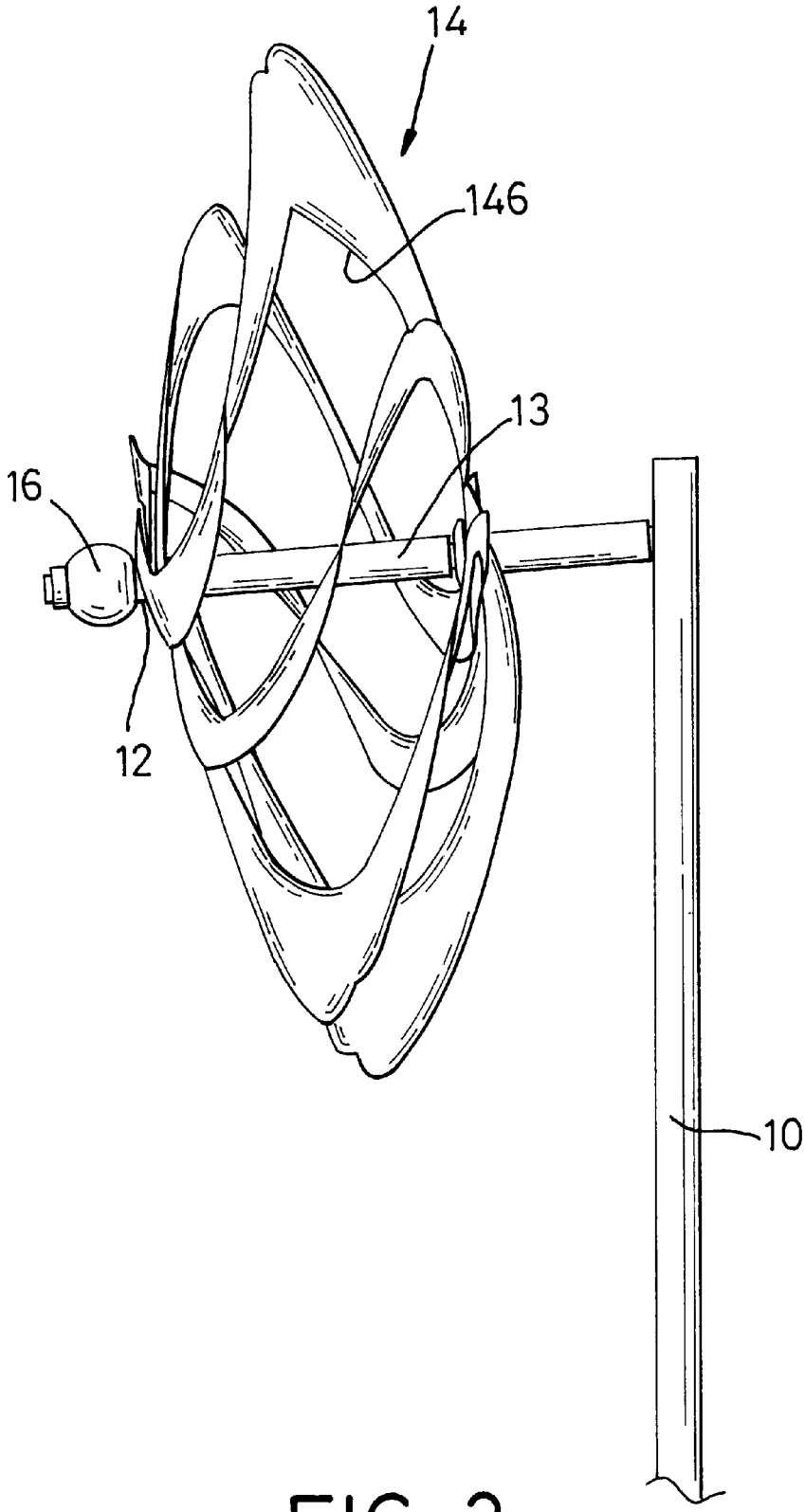
FIG. 3 is a side plan view of the pinwheel in FIG. 1.

With reference to FIGS. 1 to 3, a pinwheel in accordance with the present invention comprises a rod (10), a shaft (12) and multiple blade elements (14). The shaft (12) is perpendicularly attached to the rod (10) near the top of the rod (10). The blade elements (14) are rotatably connected to the shaft (12). In practice, a sleeve (13) is rotatably mounted around the shaft (12), and the blade elements (14) are securely attached to the sleeve (13j so as to be pat rotatably connected to the shaft (12) through the sleeve (13). Each blade element (14) has two ends (142,144) respectively attached to two ends of the sleeve (13). A cutout (146) is defined in each respective blade element (14), such that the blade element (14) has a large passage to allow the wind to pass through the passage in the blade element (14). Accordingly, there are many contact areas formed on each blade element (14) facing in different directions. Each blade element (14) can be made of a resilient material, such as plastic material. The blade elements (14) can be painted with fluorescence, such that the pinwheel can provide an illuminating visual effect in a dark environment. In practice, a knob (16) is securely attached to the free end of the shaft (12) to hold the sleeve (13) with the blade elements (14) in position.

With such an arrangement, because each blade element (14) has a passage for wind passing therethrough and many contact areas facing in different directions, the blade elements (14) can be actuated to rotate by wind in any direction even when the wind passes through the pinwheel from the rear side of the pinwheel. The user also can blow wind to the pinwheel from any direction to rotate the blade elements (14). Consequently, the enjoyment of using the pinwheel is improved, and the use of the pinwheel is versatile.

Figure 4:
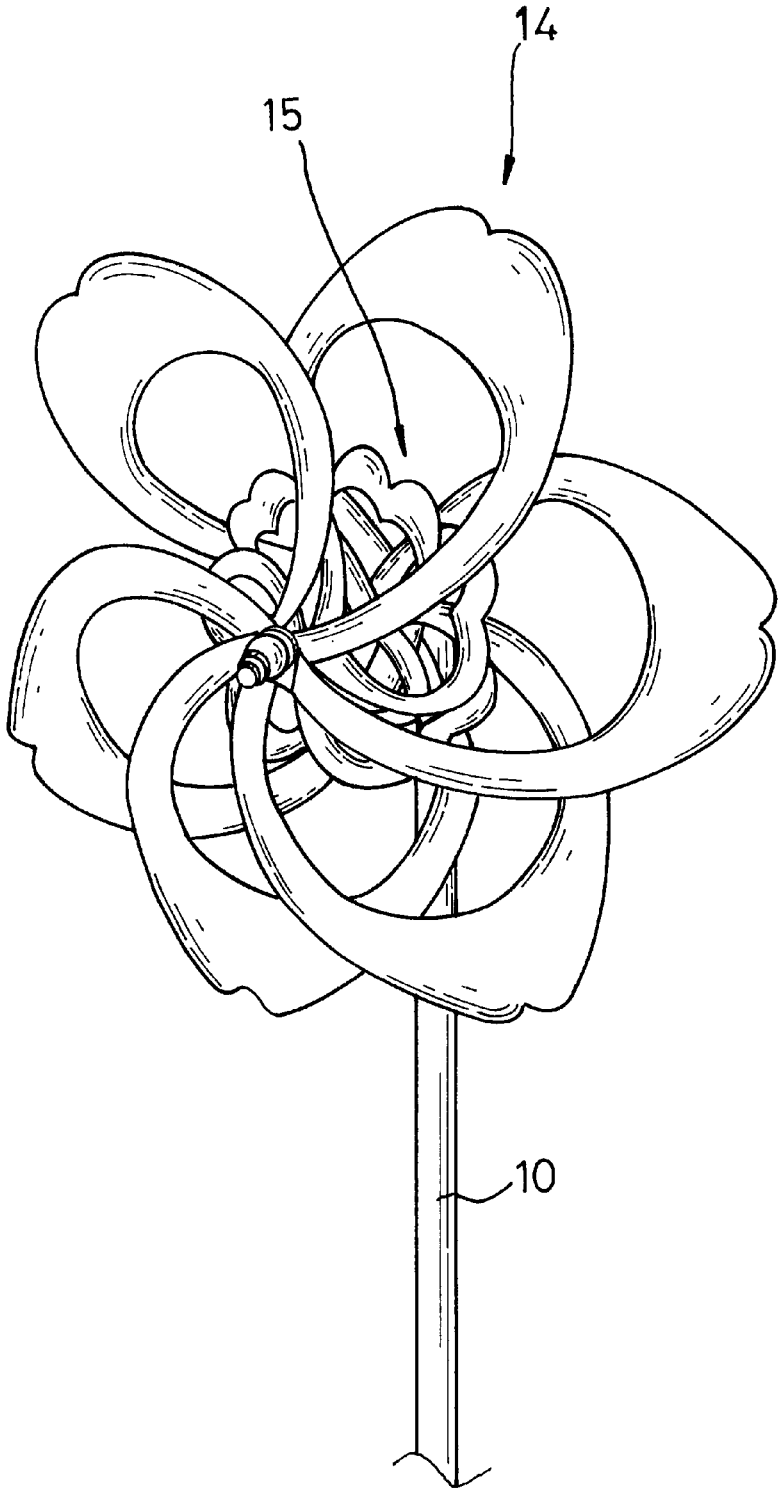
FIG. 4 is a perspective view of another embodiment of a pinwheel with multiple layers of blade elements in accordance with the present invention.
Figure 5:
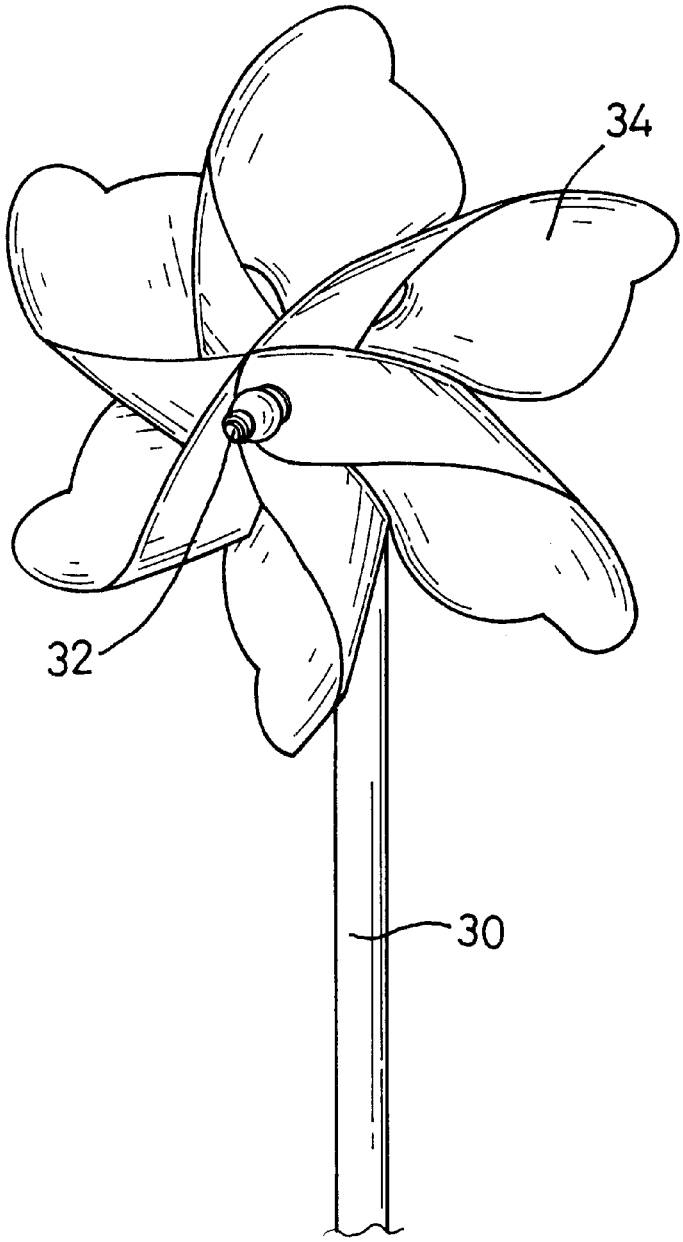
FIG. 5 PRIOR ART
FIG. 5 is a perspective view of a conventional pinwheel in accordance with the prior art.

In addition, with the blade elements (14) having cutouts (146), the appearance of the pinwheel is versatile. With reference to FIG. 4, another layer of blade elements (15) is connected to the sleeve (13) and is received in the cutouts (146) of the blade elements (14) so as to mount two layers of blade elements (14,15) onto the shaft (12). With the cutouts (146) in the blade elements (14), the inner layer of blade elements (15) is exposed so that the appearance of the pinwheel is versatile. Because the blade elements (14) have passages for wind passing therethrough, the inner layer of blade elements (15) can also be actuated to rotate by the wind. The enjoyment of and visual effect provided by the pinwheel is further improved. Furthermore, each inner blade element (15) also has a cutout, such that a third layer of blade elements (not shown) can be mounted on the shaft (12) and received in the inner blade elements (15). Consequently, multiple layers of blade elements (14,15) can be mounted on the shaft (12). Because the inner blade elements (15) are mounted inside the outer blade elements (14), the volume of the pinwheel will not increase when the amount of the layers of the blade elements (14,15) is increased. The appearance of a pinwheel with multiple layers of blade elements is novel and attractive to consumers.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pinwheel comprising:

a rod having a top;

a shaft attached to the rod near the top of the rod and having a free end;

a sleeve with two ends and rotatably mounted around the shaft; and multiple first blade elements securely attached to the sleeve, and each first blade element having two ends respectively connected to the two ends of the sleeve, respectively, so as to be rotatably connected to the shaft through the sleeve, with a cutout defined in the first blade element to define a passage in the first blade element for wind passing through the passage.

2. The pinwheel as claimed in claim 1 further comprising a knob securely attached to the free end of the shaft to hold the sleeve with the first blade elements in position.

3. The pinwheel as claimed in claim 1 further comprising multiple second blade elements attached to the sleeve and received in the cutouts of the first blade elements.

4. The pinwheel as claimed in claim 3, wherein each second blade element has a cutout to define a passage in the second blade element for wind passing through the passage.

* * * * *